US006748633B2

(12) United States Patent
Legl et al.

(10) Patent No.: US 6,748,633 B2
(45) Date of Patent: Jun. 15, 2004

(54) APPARATUS FOR NEEDLING A NON-WOVEN MATERIAL

(75) Inventors: Ludwig Legl, Buchkirchen (AT); Hellmuth Stachel, Vienna (AT)

(73) Assignee: Textilmaschinenfabrik Dr. Ernst Fehrer Aktienegesellschaft, Leonging (AT)

( * ) Notice: Subject to any disclaimer, the term of this patent is extended or adjusted under 35 U.S.C. 154(b) by 246 days.

(21) Appl. No.: 10/124,840

(22) Filed: Apr. 18, 2002

(65) Prior Publication Data

US 2002/0162203 A1 Nov. 7, 2002

(30) Foreign Application Priority Data

Apr. 19, 2001 (AT) ..... 633/2001

(51) Int. Cl.[7] ..... D04H 18/00
(52) U.S. Cl. ..... 28/114
(58) Field of Search ..... 28/114, 107, 108, 28/109, 110, 111, 112, 113, 115; 112/80.4, 80.45, 80.42, 80.41

(56) References Cited

U.S. PATENT DOCUMENTS

| | | | | | |
|---|---|---|---|---|---|
| 2,845,687 | A | * | 8/1958 | Howard | 28/114 |
| 4,777,706 | A | * | 10/1988 | Stanislaw | 28/110 |
| 4,891,870 | A | * | 1/1990 | Muller | 28/107 |
| 5,390,556 | A | * | 2/1995 | Nencini et al. | 74/38 |
| 5,548,881 | A | * | 8/1996 | Ludwig | 28/114 |
| 5,568,678 | A | * | 10/1996 | Fehrer | 28/115 |
| 5,636,420 | A | * | 6/1997 | Jourde et al. | 28/107 |
| 5,732,453 | A | * | 3/1998 | Dilo et al. | 28/114 |
| 6,000,112 | A | * | 12/1999 | Ollinger et al. | 28/107 |
| 6,161,269 | A | * | 12/2000 | Dilo et al. | 28/114 |
| 6,266,856 | B1 | * | 7/2001 | Fehrer et al. | 28/107 |
| 6,481,071 | B1 | * | 11/2002 | Fehrer et al. | 28/107 |
| 6,568,051 | B2 | * | 5/2003 | Legl et al. | 28/114 |
| 6,584,659 | B2 | * | 7/2003 | Legl et al. | 28/114 |

FOREIGN PATENT DOCUMENTS

| | | |
|---|---|---|
| DE | 2 264 257 | 11/1973 |
| DE | 196 15 697 | 3/1997 |
| EP | 0 596 097 | 5/1993 |
| EP | 0 669 996 | 8/1996 |
| EP | 0 892 102 | 1/1999 |

* cited by examiner

*Primary Examiner*—Amy B. Vanatta
(74) *Attorney, Agent, or Firm*—Collard & Roe, P.C.

(57) ABSTRACT

An apparatus is described for needling a non-woven material with a support (3) which receives at least one needleboard (1) and is drivable in a reciprocating fashion both in the needle-penetration direction (5) as well as the direction of passage (6) of the non-woven material and on which are coupled the connecting rods (10) of two oppositely drivable eccentric drives (8, 9) for the drive in the needle-penetration direction (5) and on which there acts at least one additional eccentric drive (12). In order to provide advantageous constructional conditions it is proposed that the connecting rods (10) of the two oppositely drivable eccentric drives (8, 9) extend inclined in opposite directions with respect to the needle-penetration direction (5), that the additional eccentric drive (12) revolves synchronously with one of the two other eccentric drives (8, 9), that the connecting rod (15) of the additional eccentric drive (12) which is also linked to the support (3) forms with the connecting rod (10) of the synchronously revolving eccentric drive (8) a parallelogram of links for guiding the support (3) and that the eccentric drives (8, 9) which are drivable in opposite directions are provided with a phase shift (ϕ) or are adjustable with respect to the mutual angular position.

6 Claims, 6 Drawing Sheets

APPARATUS FOR NEEDLING A NON-WOVEN MATERIAL

FIELD OF THE INVENTION

The invention relates to an apparatus for needling a non-woven material with a support receiving at least one needleboard, which support is drivable in a reciprocating fashion both in the needle-penetration direction as well as the direction of passage of the non-woven material and on which are coupled the connecting rods of two oppositely driven eccentric drives for the drive in the needle-penetration direction and on which there acts at least one additional eccentric drive.

DESCRIPTION OF THE PRIOR ART

In order to reduce the draft of a non-woven material drawn continuously by a needling apparatus on the one hand and to increase the advance of the non-woven material on the other hand it is known (DE 196 15 697 A1) to provide an additional eccentric drive for a needleboard movement in the direction of passage of the non-woven material in addition to the needleboard drive reciprocating in the needle-penetration direction, so that due to the movement component of the needles in the direction of passage of the non-woven material the tensile load of the non-woven material as occurs during the needle penetration is reduced or the advance of the non-woven material is increased accordingly. In order to set the oscillating amplitude of the needleboard in the direction of passage of the non-woven material, it has already been proposed in this connection (EP 0 892 102 A2) to equip the additonal needleboard drive with two parallel eccentric shafts whose connecting rods are mutually connected by a coupler linked to a support for the needleboard. By making a respective choice of the mutual angular position of the two eccentric shafts it is possible to set the needleboard advance in the direction of passage of the non-woven material. This simple possibility for adjustment is gained with the disadvantage that the support which is coupled with the connecting rods of the two eccentric drives for the needleboard drive in the needle-penetration direction performs a reciprocating swivelling movement which produces a respective swivelling movement of the needlings in the non-woven material during the needle penetration.

For two mutually opposite needleboards which are used alternatingly it is known (DE 2 264 257 A) to arrange said needleboards in a common frame which is driven reciprocatingly in the needle-penetration direction via an eccentric drive, while the additional movement component in the direction of passage of the non-woven material is ensured by two oppositely driven eccentric drives which each act on the frame via a connecting rod and simultaneously assume its guidance in the needle-penetration direction in form of a parallelogram of links. This known design does not allow any setting of the oscillating amplitude of the frame in the direction of passage of the non-woven material.

SUMMARY OF THE INVENTION

The invention is based on the object of providing an apparatus for needling a non-woven material of the kind mentioned above in such a way that advantageous conditions are provided on the one hand for a construction of a needleboard drive of low complexity both in the needle-penetration direction as well as in the direction of passage of the non-woven material and on the other hand for a simple setting of the needleboard advance in the direction of passage of the non-woven material without having to swivel the needleboard.

This object is achieved by the invention in such a way that the connecting rods of the two oppositely driven eccentric drives extend in opposite directions with respect to the needle-penetration direction, that the additional eccentric drive revolves synchronously with one of the two other eccentric drives, that the connecting rod of the additional eccentric drive which is also coupled with the support forms a parallelogram of links for guiding the support with the connecting rod of the synchronously revolving eccentric drive, and that the oppositely drivable eccentric drives are provided with a phase shift or are adjustable with respect to the mutual angular position.

Since the connecting rods of the two oppositely drivable eccentric drives for the needleboard drive in the needle-penetration direction are not provided, as is otherwise usual, with a central position extending in the needle-penetration direction but extend inclined in opposite directions with respect to the needle-penetration direction, the support for the needleboard can be driven along an inherently closed trajectory by a phase shift between said two eccentric drives, which allows an advantageous adjustment of the needle movement to the advancement of the non-woven material when the support is guided parallel with respect to itself. For this purpose the connecting rod of the additional eccentric drive forms a parallelogram of links with the connecting rod of the synchronously revolving eccentric drive of the two other eccentric drives, which ensures the parallel guidance of the support and thus a swivel-free needle penetration into the non-woven material. Since already a comparatively small mutual offset of the angular position of the two eccentric drives revolving in opposite directions will produce a curved path for the support with a respective component in the direction of passage of the non-woven material, the horizontal component of the needleboard drive can be adjusted in a sensitive way to the respective conditions via the phase shift of the oppositely driven eccentric drives, namely with a relatively low amount of constructional effort.

Although an additional eccentric drive is sufficient for the parallel guidance of the support, particularly simple constructional conditions are obtained with respect to the balancing of masses when two additional eccentric drives are provided which revolve synchronously with one each of the two other eccentric drives and form a parallelogram of links each with the same.

The eccentric drives forming a parallelogram of links for guiding the support can be arranged differently depending on the spatial conditions. It is possible for example to arrange the eccentric drives forming a parallelogram of links for guiding the support behind one another in the needle-penetration direction, which allows a compact overall length. In order to reduce the overall height the eccentric drives forming a parallelogram of links for guiding the support can be arranged adjacent to one another in the direction of passage of the non-woven material, which naturally entails a longer overall length. Such different arrangements of the eccentric drives forming a parallelogram of links for guiding the support have no influence on the curve path of the support. As a result of the parallel guidance of the support this also applies in the case that the connecting rods of the two eccentric drives which are drivable in opposite directions are not linked at a mutual distance to the support, but via a common coupling shaft. The shape of the curve path of the support depends on the one hand on the phase shift between the oppositely drivable eccentric drives and on the other hand on their eccentricity, the length of the connecting rods and the mean inclination of the connecting rods with respect to the needle-penetration direction, so that the trajectories of the supports can be designed via these influencing variables for certain needle-penetration conditions. If for example the connecting rods are provided on the side of the eccentric drive which is averted from the needleboard, the course of the trajectories offers considerably better needle-penetration conditions for many applications than in an arrangement in which the connecting rods are provided on the side of the eccentric drives which faces the needleboard.

BRIEF DESCRIPTION OF THE DRAWINGS

The subject matter of the invention is shown by way of examples in the drawings, wherein.

DESCRIPTION OF THE PREFERRED EMBODIMENT

Figure 1:
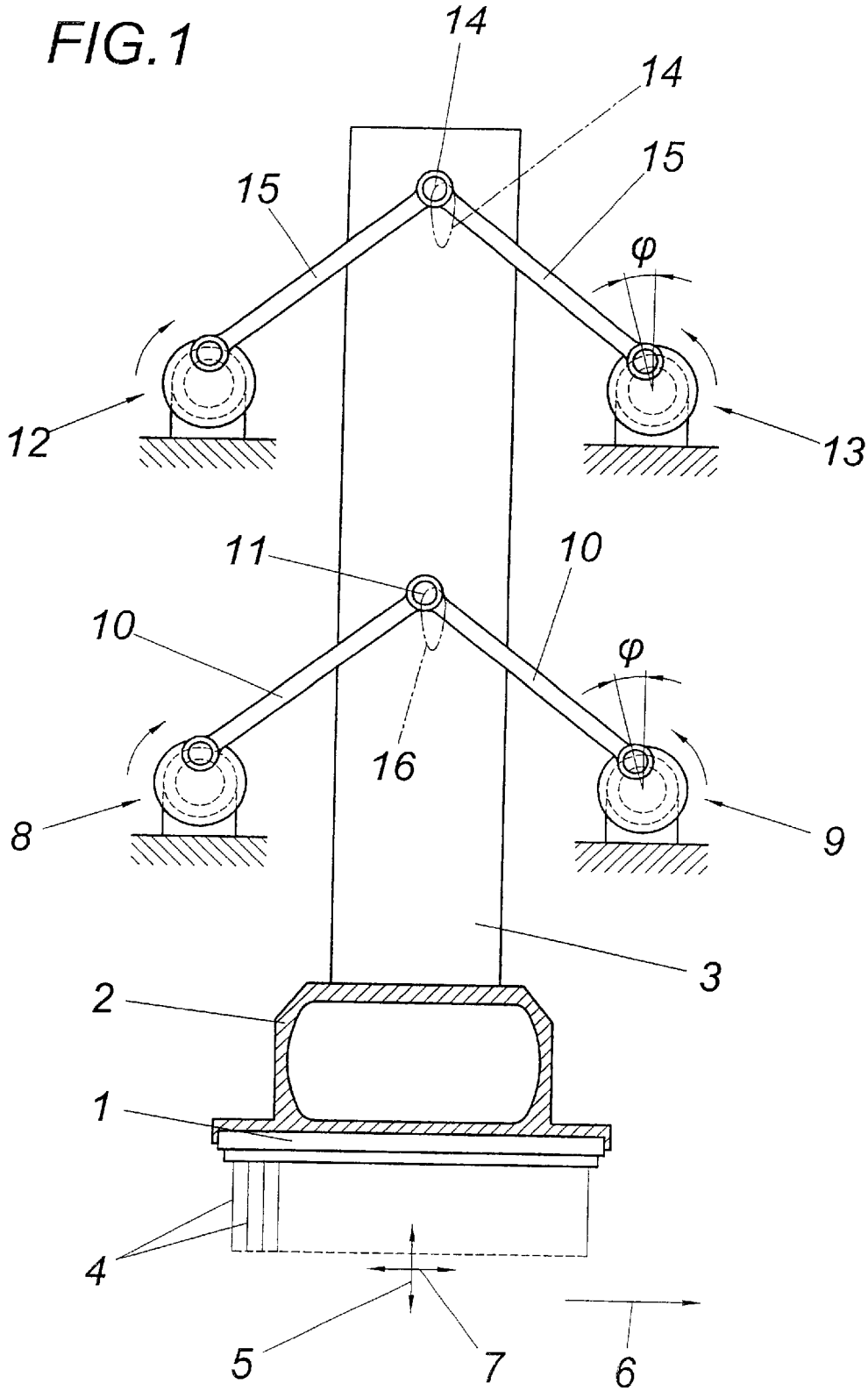
FIG. 1 shows an apparatus in accordance with the invention for needling a non-woven material in sections in a schematic side view.

According to FIG. 1, a needleboard 1 is held in a needle beam 2 which is provided on a support 3. The needles 4 of the needleboard 1 penetrate a non-woven material repeatedly in the needle-penetration direction 5, which non-woven is guided on a stitch base and is drawn off continuously in the direction of passage 6 of the non-woven material, with the needles 4 which penetrate the non-woven material holding back the non-woven material with respect to the draft. In order to thus reduce the draft of the non-woven material which is thus produced, the needles 4 are additionally driven reciprocatingly in the direction of passage 6 of the non-woven material, as is indicated by arrow 7.

In order to obtain a needleboard drive both in the needle-penetration direction 5 as well as the direction of arrow 7 with simple constructional means, two oppositely revolving eccentric drives 8 and 9 are provided at first whose connecting rods 10 are coupled with support 3 via a common coupling shaft 11. In addition to the two eccentric drives 8 and 9 there are two eccentric drives 12 and 13 which revolve synchronously with the eccentric drives 8 and 9 and whose connecting rods 15 which act on a common coupling shaft 14 form a parallelogram of links each for guiding the support 3 with the connecting rods 10 of the synchronously revolving eccentric drives 8 and 9, which parallelogram can therefore merely be displaced parallel with respect to itself. If the eccentric drives 8, 9 and 12, 13 are driven without any mutual phase shift, the support 3 is driven in a reciprocating manner merely in the needle-penetration direction 5, namely with a stroke corresponding to approximately twice the eccentricity of the eccentric drives 8, 9 and 12, 13. If, on the other hand, one of the eccentric drives 8, 9 and 12, 13 which are arranged in pairs is twisted with respect to the other eccentric drive by a phase angle $\phi$, as is indicated for the eccentric drives 9 and 13, the support 3 is not driven reciprocatingly not only in the needle-penetration direction 5 but also in the direction of arrow 7, namely along a trajectory 16 whose depends not only on the phase shift $\phi$, but also on the dimension of the eccentricity of the eccentric drives 8, 9 and 12, 13, the length of the connecting rods 10 and 15 and the inclination of the mean connecting rod position with respect to the needle-penetration direction 5.

Figure 2:
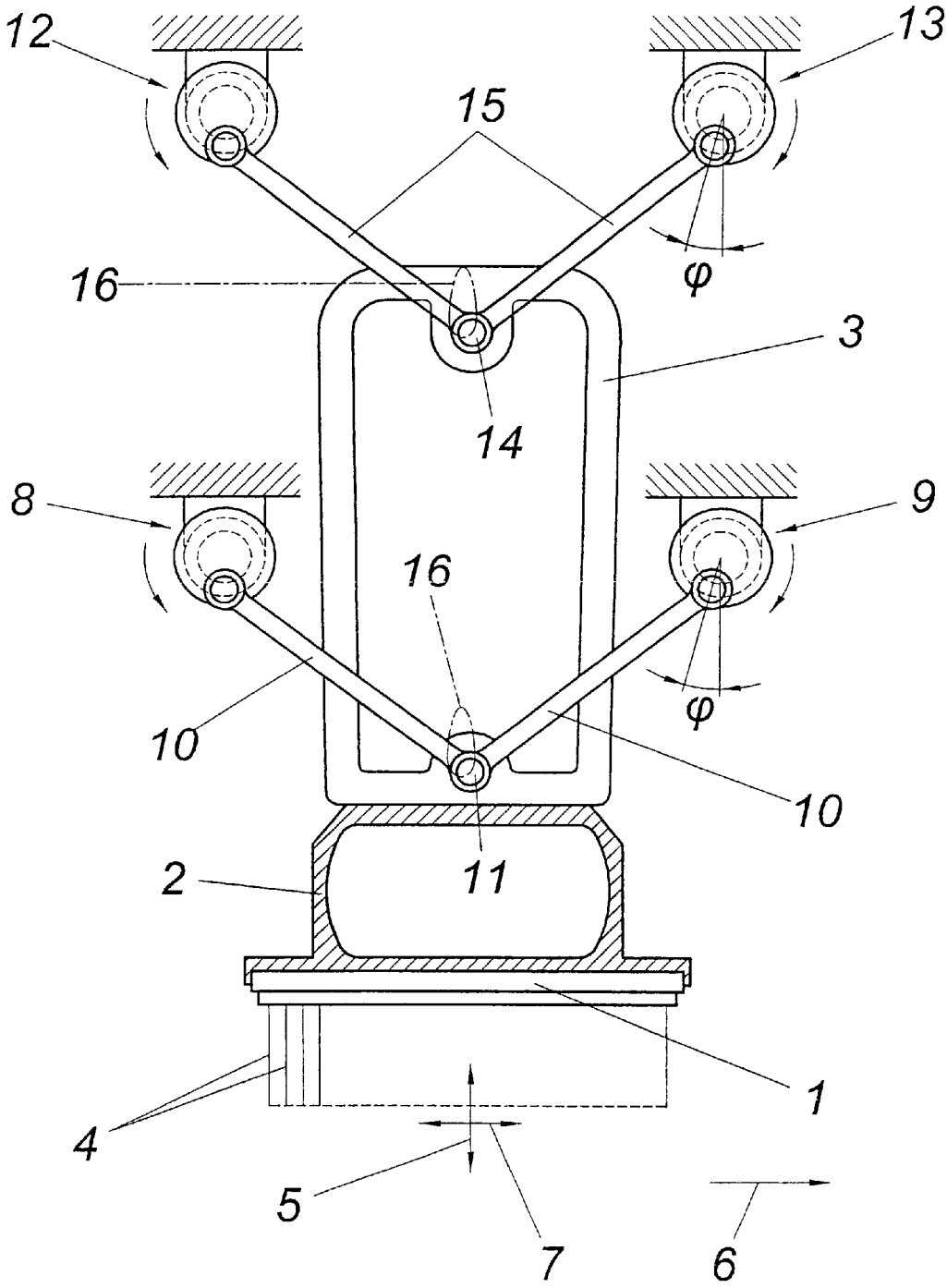
FIG. 2 shows a representation according to FIG. 1 of a constructional variant.

The drive of the support 3 according to FIG. 2 differs from that of FIG. 1 merely in such a way that the connecting rods 10 and 15 are provided according to FIG. 2 not on the side of the eccentric drives 8, 9 and 12, 13 which is averted from the needleboard 1, but on the side facing the needleboard 1. Although there are corresponding trajectories 16 as a result of the corresponding parameters of the eccentric drives 8, 9 and 12, 13, the trajectories 16 are not symmetrical, so that there are different needle-penetration conditions due to the different position of the trajectories 16. As is shown by the trajectories 16 which are illustrated in an overly asymmetric way, more favourable needle-penetration conditions are obtained for the usual applications by the connecting rod arrangement on the side of the eccentric drives which is averted from the needleboard 1, namely as a result of the trajectory which is narrower in the needle-penetration zone.

Figure 3:
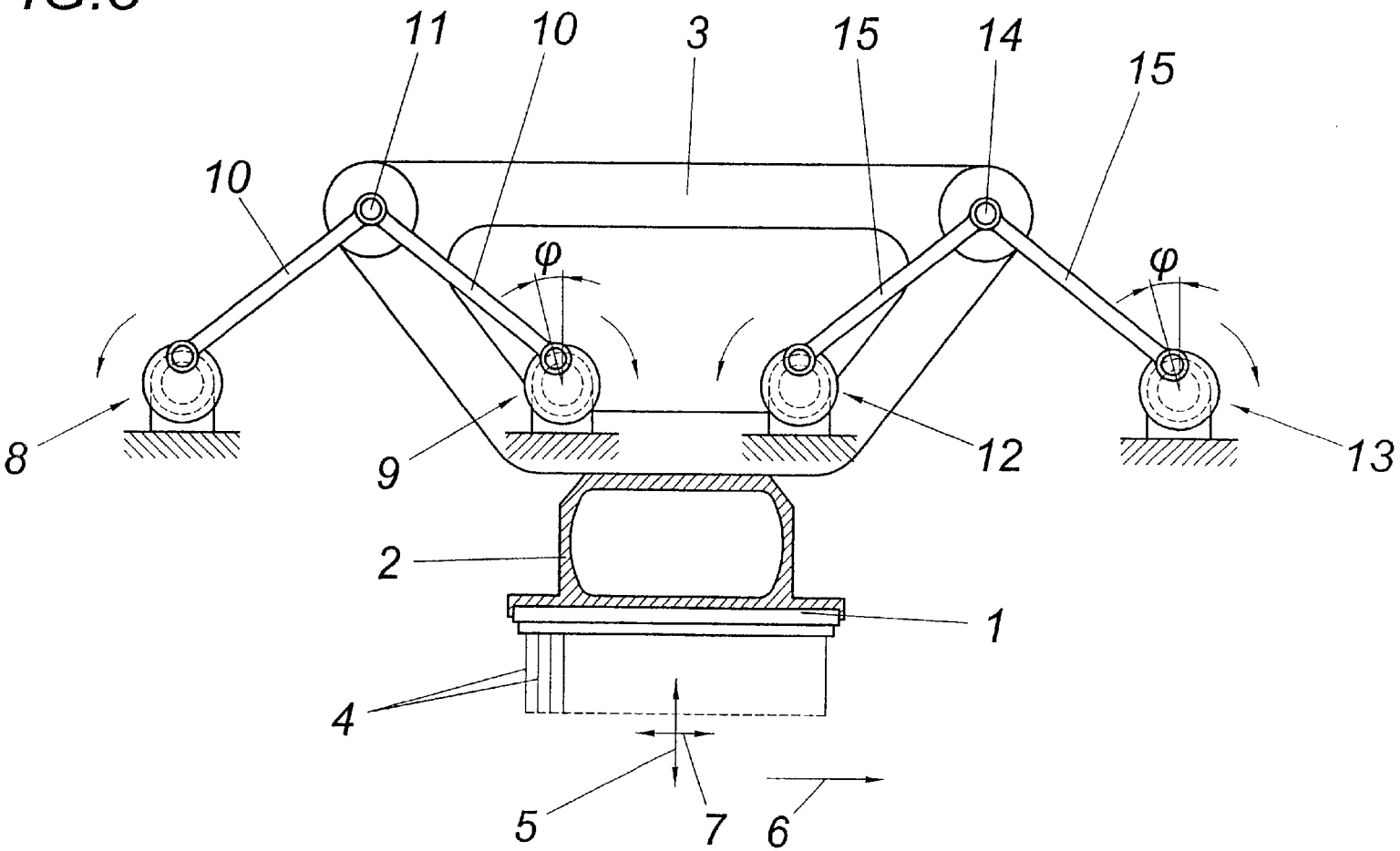
FIG. 3 shows a further constructional variant of an apparatus in accordance with the invention for needling a non-woven material with drive conditions comparable to FIG. 1.
Figure 4:
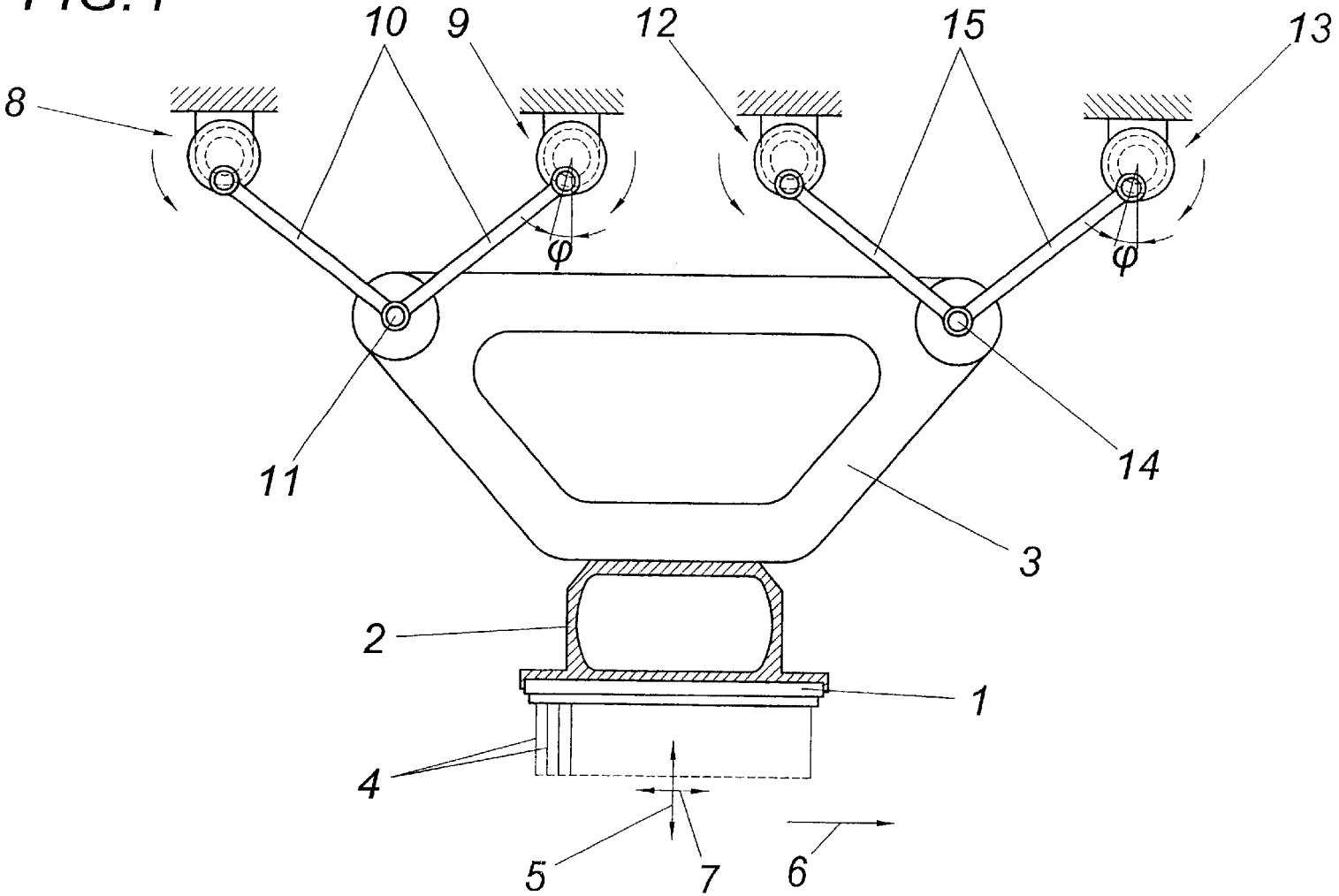
FIG. 4 shows a needle apparatus according to FIG. 3, but with drive conditions corresponding to those of FIG. 2.

The construction as shown in FIGS. 1 and 2 with two pairs of eccentric drives 8, 9 and 12, 13 which are disposed behind one another in the needle-penetration direction can be modified according to FIGS. 3 and 4 in such a way that eccentric drives 8, 9 and 12, 13 which are act in pairs on the support 3 come to lie next to one another in the direction of passage 6 of the non-woven material. The trajectories along which the support 3 is driven according to FIGS. 3 and 4 correspond to the trajectories 16 according to FIGS. 1 and 2. There are other load conditions, however, as can be seen immediately.

Figure 5:
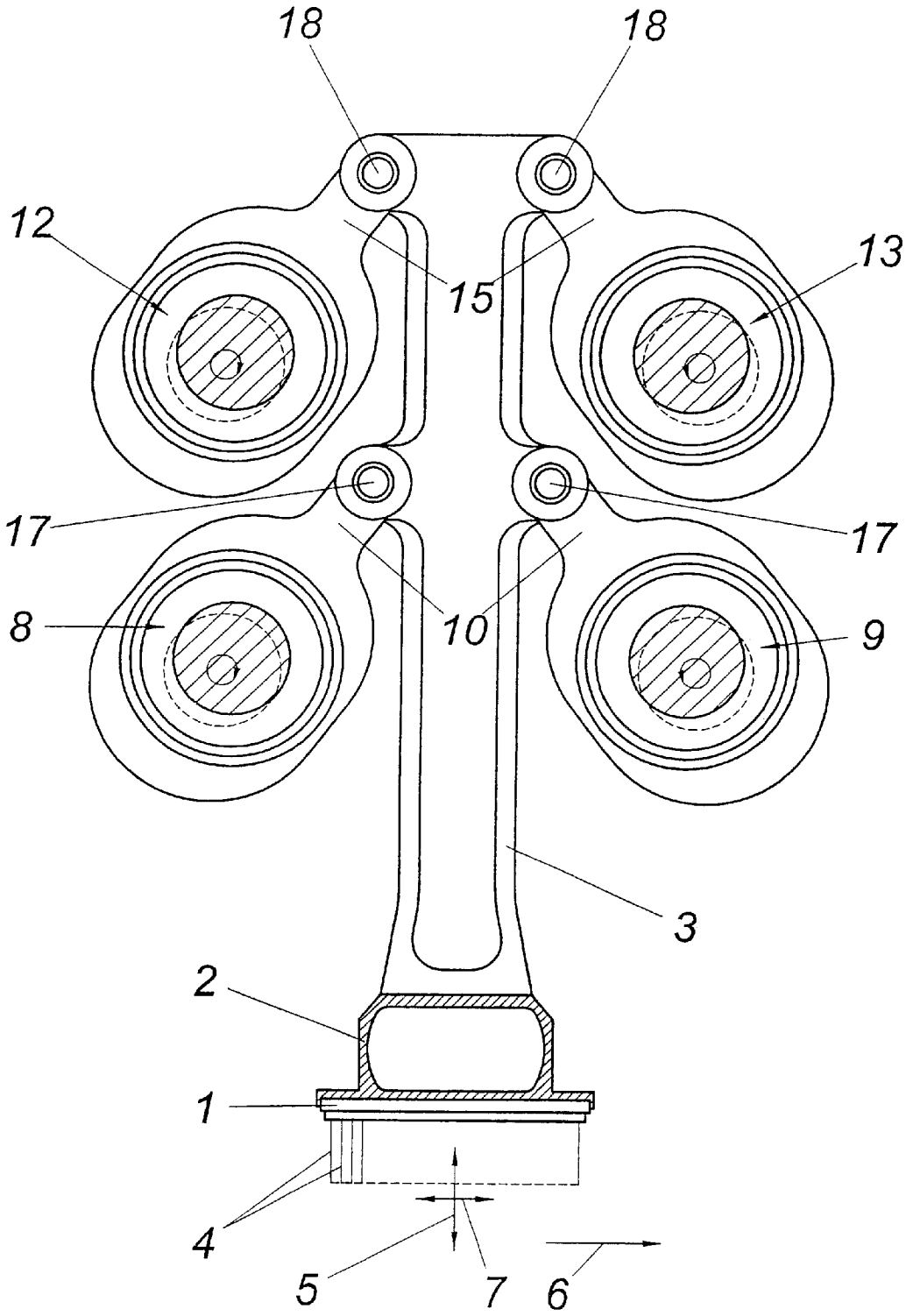
FIG. 5 shows a constructional example of a drive arrangement according to FIG. 1.

In FIG. 5 a construction is shown according to FIG. 1 with the difference that the connecting rods 10 and 15 of the eccentric drives 8, 9 and 12, 13 which are arranged in pairs do not act jointly on common coupling shafts, but are each provided with coupling shafts 17 and 18 which have a mutual distance from one another. As a result of the guidance of support 3 via the parallelogram of links of connecting rods 10, 15, mutually coinciding movement conditions are obtained, however.

Figure 6:
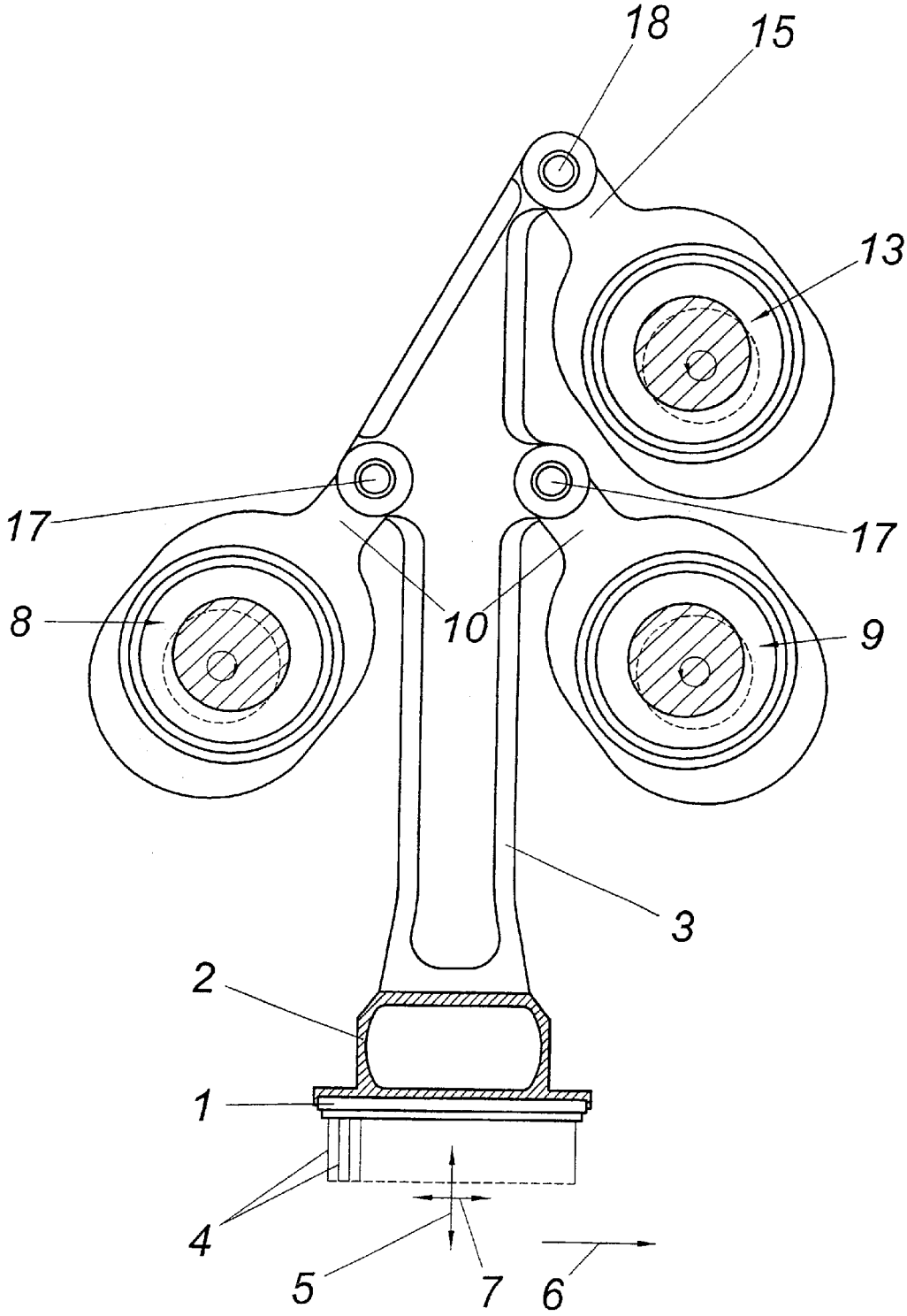
FIG. 6 shows an apparatus for needling a non-woven material in the principal embodiment according to FIG. 5, but with merely one additional eccentric drive.

As is shown in FIG. 1 directly, the support 3 can merely be swivelled about the coupling shaft 11 with respect to the eccentric drives 8 and 9. For a parallelogram guidance of the support 3 it is possible to omit one of the two additional eccentric drives 12 or 13 without impairing the guidance of the support 3. One must merely ensure that due to an additional eccentric drive 12 or 13 which revolves synchronously with one of the two eccentric drives 8 or 9 there is a parallelogram of links via the connecting rods 10 and 15 of said synchronously revolving eccentric drives 8 and 12 or 9 and 13. This applies similarly when the coupling shafts 17 of the eccentric drives 8 and 9 according to FIG. 5 do not coincide. FIG. 6 shows such a construction with merely one additional eccentric drive 13. As can be seen directly, it is necessary to ensure a sufficient balancing of masses in such an arrangement by additional measures, which generally leads to a respective mass balancing shaft.

It is understood that the invention is not limited to the embodiments as illustrated herein, which are used to explain the principle of the construction. Thus, the eccentric drives 8, 9 and 12, 13 consist of two or more eccentrics disposed axially behind one another on an eccentric shaft, with the connecting rods being formed by individual guide rods which are held on the eccentrics and are coupled with the support.

What is claimed is:

1. An apparatus for needling a non-woven material with a support which receives at least one needleboard and is drivable in a reciprocating fashion both in the needle-penetration direction as well as the direction of passage of the non-woven material and on which are coupled connecting rods of two oppositely drivable eccentric drives for the drive in the needle-penetration direction and on which there acts at least one additional eccentric drive, characterized in that the connecting rods (10) of the two oppositely drivable eccentric drives (8, 9) extend inclined in opposite directions with respect to the needle-penetration direction (5), that the additional eccentric drive (12) revolves synchronously with one of the two other eccentric drives (8, 9), that a connecting rod (15) of the additional eccentric drive (12) which is also linked to the support (3) forms with the connecting rod (10) of the synchronously revolving eccentric drive (8) a parallelogram of links for guiding the support (3) and that the eccentric drives (8, 9) which are drivable in opposite directions are provided with a phase shift (ϕ) or are adjustable with respect to the mutual angular position.

2. An eccentric drive as claimed in claim 1, characterized in that two additional eccentric drives (12, 13) are provided which revolve synchronously with one each of the two other eccentric drives (8, 9) and form with the same a parallelogram of links each.

3. An apparatus as claimed in claim 1, characterized in that eccentric drives (8, 12 and 9, 13) forming a parallelogram of links for guiding the support (3) are disposed behind one another in the needle-penetration direction (5).

4. An apparatus as claimed in claim 1, characterized in that the eccentric drives (8, 12 and 9, 13) forming a parallelogram of links for guiding the support (3) are disposed next to one another in the direction of passage (6) of the non-woven material.

5. An apparatus as claimed in claim 1, characterized in that the connecting rods (10) of the two 2 eccentric drives (8, 9) which are drivable in opposite directions are linked via a common coupling shaft (11) to the support (3).

6. An apparatus as claimed in claim 1, characterized in that the connecting rods (10) are provided on the side of the eccentric drive (8, 9, and 12, 13) which is averted from the needleboard (1).

* * * * *